US007243821B2

(12) United States Patent
Bougamont et al.

(10) Patent No.: US 7,243,821 B2
(45) Date of Patent: Jul. 17, 2007

(54) PRODUCT DISPENSER COMPRISING A TAPPET-ACTIVATED PUMP

(75) Inventors: Jean-Louis Bougamont, Eu (FR); Maurice Petitjean, Florenville (BE); Pierre Dumont, Monchy-sur-Eu (FR)

(73) Assignee: Rexam Dispensing Systems S.A.S. (FR)

( * ) Notice: Subject to any disclaimer, the term of this patent is extended or adjusted under 35 U.S.C. 154(b) by 17 days.

(21) Appl. No.: 11/236,387

(22) Filed: Sep. 27, 2005

(65) Prior Publication Data

US 2006/0065675 A1 Mar. 30, 2006

Related U.S. Application Data

(63) Continuation of application No. PCT/EP2004/003116, filed on Mar. 24, 2004.

(30) Foreign Application Priority Data

Mar. 27, 2003 (FR) ..... 03 03755

(51) Int. Cl.
*B65D 83/00* (2006.01)

(52) U.S. Cl. ..... 222/321.5; 222/321.9

(58) Field of Classification Search .. 222/321.1–321.9, 222/383.1, 385

See application file for complete search history.

(56) References Cited

U.S. PATENT DOCUMENTS 4,762,475 A * 8/1988 Fuchs ..... 417/550
5,110,052 A 5/1992 Graf et al. ..... 239/333
5,284,276 A * 2/1994 Cater ..... 222/321.9
5,469,990 A * 11/1995 Wodeslavsky ..... 222/148
6,769,576 B2 * 8/2004 Ichikawa ..... 222/321.5
2002/0047027 A1 4/2002 Sogaro ..... 222/321.9
2004/0035886 A1 * 2/2004 Cordomi ..... 222/321.9

FOREIGN PATENT DOCUMENTS

FR 2 740 118 A 4/1997
WO WO 98/53917 A 12/1998
WO WO 02/094708 A 11/2002

OTHER PUBLICATIONS

International Search Report, Jul. 9, 2004 (3 pages).

* cited by examiner

*Primary Examiner*—J. Casimer Jacyna
(74) *Attorney, Agent, or Firm*—St. Onge Steward Johnston & Reens LLC

(57) ABSTRACT

The dispenser comprises a reservoir and a pump that is activated by a tappet, comprising a pump body that includes a tubular part with a smaller gauge than that of the reservoir, covering the piston, and an annular spacer by means of which it is tightly mounted against the inner wall of the reservoir such as to define an annular chamber for the product, which communicates with a dosage chamber located in the bottom of the reservoir.

14 Claims, 3 Drawing Sheets

PRODUCT DISPENSER COMPRISING A TAPPET-ACTIVATED PUMP

This application is a continuation of International Patent Application No. PCT/EP2004/003116 filed on Mar. 24, 2004 which designates the United States and claims priority of French Patent Application No. 0303755 filed on Mar. 27, 2003.

FIELD OF THE INVENTION

This invention refers to a dispenser for liquid or moderately pasty products, essentially made up of a reservoir and a pump that is activated by a tappet, said pump being fitted forcefully into the reservoir. The invention is applied more specifically in the field of distribution of cosmetic products. It provides, mainly, a dispenser for gel or cream for cosmetic use. In another field, that of sprayers, the invention can also be applied to a sprayer designed to contain a dose of a luxury product, such as a perfume, for instance. In the latter case, the dispenser is equipped with a spraying nozzle. Such dispensers or sprayers, when they are miniaturized, are mainly intended for free distribution to customers, in order for the latter to discover and appreciate the products they contain.

In the fields defined above, our constant aim is to simplify the structure of the device and to reduce the manufacturing costs. Therefore, we seek to reduce the number of components and to make them simpler to manufacture, mainly by molding. We also aim to make assembly more straightforward.

For example, in the field of dispensers of thick or pasty products, such as certain cosmetics, document FR 2 740 118 describes a device in which a pumping chamber is defined that contains the entire product. This chamber is directly defined between the reservoir and a piston. The device does not allow the extracted amount to be dosed.

Furthermore, a liquid product dispenser is known, mainly a sprayer, generally comprising a reservoir and a tappet pump installed in this reservoir. The pump comprises a pump body in which a piston is mounted. A chamber for dosing the liquid is defined in the body of the pump and the piston forms a mobile wall of this chamber. A suction valve establishes a connection between the dosage chamber and the reservoir that contains the liquid to be sprayed, and an outlet valve establishes a connection between the dosage chamber and the means for dispensing the product. A spring moves the piston into a predetermined idle position in which the dosage chamber reaches its maximum volume. The pump body is mounted in the opening of the reservoir. Each time the tappet is pressed, a predetermined amount of the product is expelled.

The object of the invention is to simplify the structure of a dosing dispenser that can be adapted for a cream or gel cosmetic product or for a liquid product to be sprayed. The invention makes it possible to reduce the number of parts it comprises.

More specifically, the invention relates to a dispenser for liquid or thick products comprising a reservoir and a tappet-activated pump, said tappet being connected to a mobile piston inside a pump body, characterised in that said pump body comprises a tubular part of a smaller gauge than that of the reservoir, covering the piston and an annular spacer by means of which it is mounted tight against the inner wall of the pump body in order to create an annular chamber for said product between outer surface of said tubular part and the inner surface of said reservoir, in that a cylindrical dosage chamber, which communicates with said annular chamber, is located in the bottom of said reservoir, in that said piston is inserted and slides in a watertight manner inside said dosage chamber when said tappet is pressed and in that an outlet valve is installed in said piston.

According to a possible manufacturing method, the dosage chamber is defined in the bottom of the pump body which, since it no longer comprises the standard suction pipe, is inserted all the way into the reservoir. In these conditions, the dosage chamber is placed at the very bottom of the reservoir and the product enclosed in said annular chamber can pour, by the action of gravity, into said dosage chamber when the piston is not activated. In this position, the dosage chamber communicates with the annular chamber by means of lateral passages in the pump body. This communication is cut off by the piston when the tappet is pressed.

According to another possible manufacturing method, the dosage chamber is defined in the actual reservoir, in the bottom of the reservoir. Said reservoir comprises a smaller-gauge part that forms said cylindrical dosage chamber and the inner end of the pump body opens onto said dosage chamber in order to enable said piston to enter such chamber. This manufacturing method has the advantage that the pump body can be produced in a single piece. In this case, the reservoir may comprise an annular shoulder defined between the annular chamber and the dosage chamber and the pump body may rest against this shoulder, which accurately stabilises the position of the latter inside the reservoir. The aforementioned passages are made near the inner end of the pump body in order to allow the product to pour, by the action of gravity, from the annular chamber into the dosage chamber.

According to another manufacturing method, the inner end of the piston comprises a tapered skirt made from a relatively flexible material, sized so that its circular free edge can slide in a watertight manner in the dosage chamber. This tapered skirt can therefore guarantee that a certain pressure is maintained inside the dosage chamber when the tappet is pressed. It is a part of the outlet valve.

The "inner end" of an element means the end that is inserted the farthest in the reservoir.

According to a further manufacturing method, the piston comprises a rigid rod mounted by force in an axial coupling of the tappet, and the tapered skirt is extended by a moulded tubular portion and mounted on said rod. The aforementioned outlet valve is defined between a widened free end of said rod and an annular rib that projects from the inner surface of said tapered skirt. An outlet channel is made between said outlet valve and the outlet port defined in the tappet. In the case of a sprayer, the tappet covers a spraying nozzle.

According to an manufacturing method more particularly recommended for a dispenser of thick-liquid or gel cosmetic products, the tubular portion that is formed integral with the tapered skirt is mounted so that it slides on said rod with a predetermined axial clearance, which allows the outlet valve to open without creating a considerable overpressure in the dosage chamber. In this way, the product is expelled slowly, without creating a jet.

According to another manufacturing method, more particularly recommended for a dispenser of a liquid product to be sprayed, the tubular portion that is formed integral with the tapered skirt is immobilised on the rod but, due to its elasticity, the tapered skirt can distort in order to open a passage through to the outlet channel that communicates with the outlet port. The latter is generally combined with spraying means located in the tappet. In this case, the distortion of the tapered skirt required for the outlet valve to open implies a greater pressure increase inside the dosage chamber, which is favourable for spraying the product.

Advantageously, in a retracted position inside the body of a pump, the free edge of the piston is clear from the wall of the pump body; there is therefore no risk of it distorting when it is not in use, and it retains its original shape, which is suited for coming into watertight contact with the cylindrical wall of said dosage chamber.

All parts can be made from a moulded plastic material. All of them are easy to mould. On the other hand, the pump body is perfectly positioned inside the container; it is guided by the inner wall of the container and rests against the bottom of the reservoir or against the shoulder defined near the dosage chamber. Consequently, the tappet can adapt in a very tight-fitting manner to the top of the container. It comprises a lateral skirt, which enters the container, and the radial lap between the tappet and the inner wall of the container is minimum.

BRIEF DESCRIPTION OF THE DRAWINGS

The invention will be better understood and further advantages will be made apparent from reading the following description of a currently preferred manufacturing method for a liquid product dispenser according to its principle, provided only as an example, and made in reference to the appended figures, in which.

DETAILED DESCRIPTION OF DRAWINGS

Figure 1:
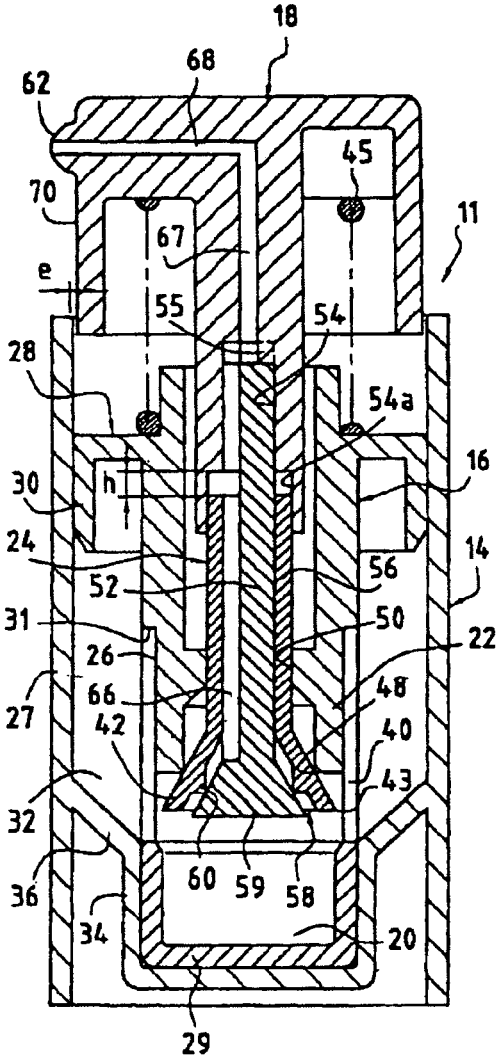
FIG. 1 is an elevation and cross-section view of a dispenser in its idle position.
Figure 2:
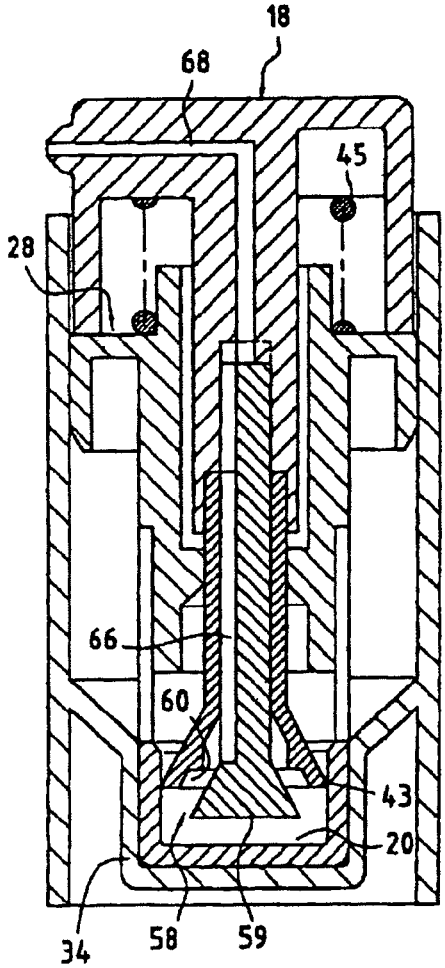
FIG. 2 is a similar view to that shown in FIG. 1, showing the dispenser in a stage in which the product is being used.

The liquid product dispenser 11 shown in FIGS. 1 and 2 in this case is a dispenser of thick or gel cosmetic products. It comprises a reservoir 14 and a pump 16 that is activated by a tappet 18. A dosage chamber 20 is defined in the bottom of the pump body 22 mounted in said reservoir. The tappet 18 is connected to a piston 24, which is mobile inside the pump body. The latter comprises a tubular part 26 with a smaller gauge than that of the reservoir body 27. The pump body covers the piston 24. In addition, the pump body 22 comprises an annular spacer 28, preferably comprising a skirt 30, as shown, mounted tight against the inner wall of the reservoir body 27. In this way, an annular chamber 32 is defined for the product to be dispensed, this annular chamber being essentially defined between the outer surface of said tubular part of the pump body and the inner surface of the reservoir body. The annular spacer 28 closes the annular chamber off at the top. The bottom of the reservoir comprises a part 34 with a smaller gauge, which is connected to the reservoir body, which has a larger gauge, by means of a tapered wall 36.

More precisely, the pump body 22 comprises two parts made from a moulded plastic material. One of these is made up of the tubular part 26 (extended radially by the annular spacer 28), which is open at its inner end. The other forms a kind of cylindrical shell 29, which fits axially onto the end of the tubular part 26 and closes off the pump body. The edge of the shell 29 rests against an outer shoulder 31 of the tubular part 26. A series of longitudinal slots made in the lateral wall of the shell 29 define passages 40 that allow the product to flow between the annular chamber 32 and the dosage chamber 20, by the action of gravity, when the piston is in a retracted position inside the pump body (FIG. 1). In this example, said dosage chamber is defined in the bottom of the shell 29.

The inner end of the tubular part 26 opens onto the dosage chamber 20 to allow the piston 24 to enter the latter when the tappet 18 is activated. In this stroke, the piston slides in a watertight manner inside the dosage chamber. The inner end of the piston, on the side of the dosage chamber, comprises a tapered skirt 42, sized so that its circular free edge 43 can slide in a watertight manner inside the dosage chamber. This tapered skirt therefore defines a suction valve with the shell 29, near the ends of the slots that define the passages 40. This valve controls the flow of the product between the annular chamber 32 and the dosage chamber 20. The piston 24 and the tappet 18 are pushed outwards from the reservoir by means of a spring 45 that is supported between a top shoulder of the pump body and the tappet. Consequently, through the action of this spring, the piston 24 retracts into the pump body and the product is able to flow, by the action of gravity, between the annular chamber 32 and the dosage chamber 20. In this position, the free edge of the piston, in other words, the edge 43 of the tapered skirt 42 is clear from the wall of the pump body. Indeed, a slight play remains between this free edge and the wall of the pump body and, consequently, in this idle position, the tapered skirt 42 of the piston is at no risk of being distorted. In this position, the outer surface of the tapered skirt is resting against a circular edge 48 defined in the pump body. This contact, which is relatively watertight, is maintained through the action of the spring 45. Obviously, in this idle position of the piston, the passages 40 between the annular chamber 32 and the dosage chamber 20 are left open. The piston 24 is guided in a sliding movement in a bore 50 of the pump body. This sliding movement is watertight enough so as not to allow the liquid to leak through this bore.

The piston 24 comprises a rigid rod 52 mounted by force in an axial coupling 54 of the tappet. The tapered skirt is extended by a tubular portion 56 which is a moulded piece mounted so that it slides along this rod. The top end of the tubular portion 56 is inserted such as to slide in a watertight manner inside a cylindrical extension 54*a* of the coupling 54 made on the inner end of the latter. In this way, the piston 24 can slide in a stroke h along the rod 52. An outlet valve 58 is formed between one widened free end 59, which is tapered in this case, of said rod and an annular rib 60 which projects from the inner surface of said tapered skirt. The tapered end 59 of the rod extends inside the tapered skirt 42. When the tappet is not activated and the piston is retracted inside the pump body, the annular rib 60 rests watertight against the widened free end 59 of the rod. This arrangement defines the outlet valve, which is closed in this position. An outlet channel is made between this outlet valve 58 and an outlet port 62 defined in the tappet. In the example, the outlet channel is defined by a groove or a flat section 66 made longitudinally on the surface of the rod 52, an axial conduit 67 made in the tappet, in the projection of the rod, and a radial conduit 68 made in the tappet and extending between the conduit 67 and the outlet port 62. A series of fins 55 are defined in the coupling 54 in order to prevent the end of the rod from blocking the axial conduit 67 of the tappet. The tappet 18 also comprises a lateral skirt 70 inserted in the opening of the reservoir. In order for the pump body 16 to be accurately positioned inside the reservoir and tightly maintained inside the reservoir by force at the level of the spacer 28, the radial lap e between the outer wall of the lateral skirt 70 of the tappet and the inner wall of the reservoir 14 is perfectly controlled and relatively small. The operation is as follows.

In the idle position, the dispenser is in the position shown in FIG. 1, the product can flow freely between the annular chamber 32 and the dosage chamber 20. The latter is therefore filled, at least by the action of gravity, whenever the dispenser is kept vertical. As soon as the tappet is pressed, the piston 24 moves towards the open bottom end of the pump body until it comes into watertight contact with the cylindrical lateral wall of the dosage chamber 20 under the passages 40. As of this point, communication between the annular chamber 32 and the dosage chamber 20 is cut off and, continuing its stroke, the piston causes a slight increase of the pressure in the dosage chamber. This pressure increase results in the tapered skirt 42 lifting up slightly, which causes the outlet valve 58 to open. As of this point, the product trapped in the dosage chamber can rise up to the outlet port 62.

It should be noted that all the parts of the dispenser can be easily manufactured. Particularly, the reservoir 14 can be easily moulded, since it consists of only one wall. Furthermore, the perfect position of the pump body 22 inside the reservoir makes it possible to obtain, as mentioned above, a very small lap e between the lateral skirt of the tappet and the inner wall of the reservoir. It is not necessary to provide a vent. The reservoir, however, can be filled practically to the top, since the product that is contained in an annular chamber 32 located above the dosage chamber 20 can always flow into the dosage chamber by the action of gravity as long as the dispenser is kept in the vertical position.

The lack of a vent is also advantageous, mainly if the product is viscous, or even pasty, since during packaging, after filling the reservoir 14 with a certain amount of the product, mounting of the pump body generates an overpressure, with air being trapped inside the reservoir, due to the watertight sliding of the skirt 30, which makes it easier to fill the dosage chamber. In addition, when the piston rises back up, a vacuum is created in the dosage chamber 20. As soon as the passages 40 are opened, the combined effect of this vacuum and the slight overpressure in the chamber 32 make it easier to fill the dosage chamber 20.

Furthermore, since no air is reinserted, the product is better protected against oxidation and possible bacteriological contamination.

It should be noted that the pump according to the invention is completely "submerged" in the product and that the pump body is completely finished off and closed at the bottom, independently from the reservoir. The pump manufacturer therefore has full control over the quality of the device.

Figure 3:
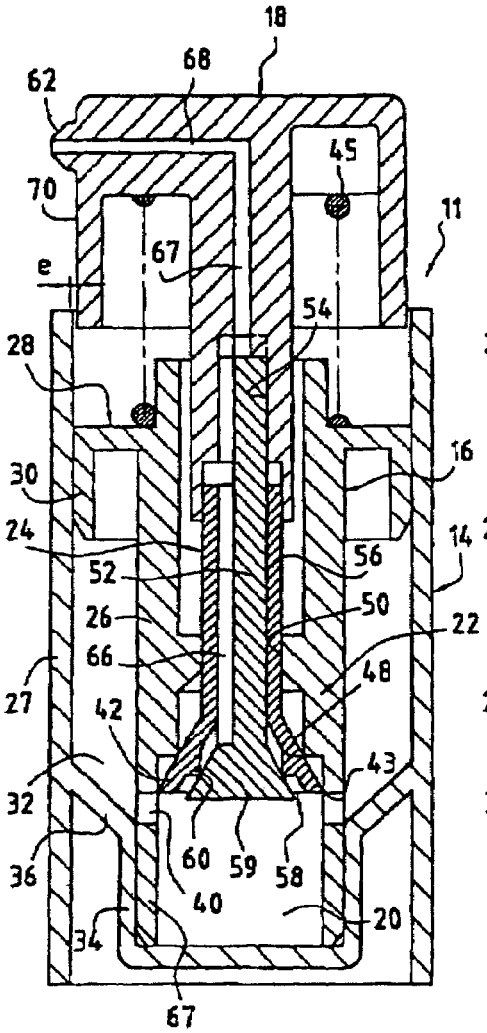
FIGS. 3 and 4 are similar views to that shown in FIG. 2, illustrating alternatives.
Figure 4:
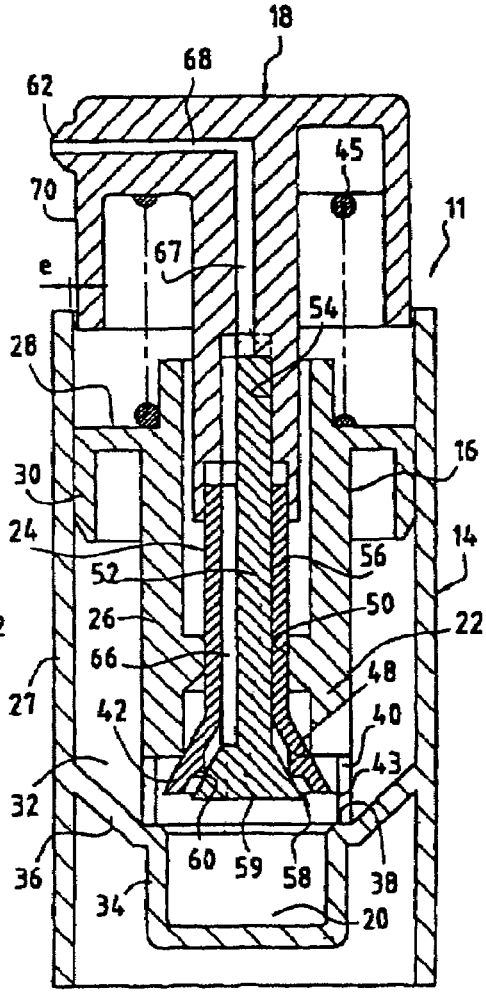

In the variant shown in FIG. 3, the pump body 16 is open at its inner end and extended by a tubular cylindrical portion 67 until the bottom of the small-gauge part 34 of the reservoir. The dosage chamber 20 is therefore defined in part by the pump body and in part by the end wall of the part 34. The pump body can therefore be moulded as a single part. The passages 40 are holes pierced in the wall of the tubular cylindrical portion 67, just above the inner edge of the tapered wall 36. In the variant shown in FIG. 4, the pump and the reservoir are combined insofar as the dosage chamber 20 is defined directly in the bottom of the reservoir 14 in the extension of the pump body 22. An annular shoulder 38 is defined between the tapered wall 36 and the edge of the small-gauge part 34, forming the essential parts of the dosage chamber. Thus, the shoulder forms a stop for the inner end of the pump body 22.

Figure 5:
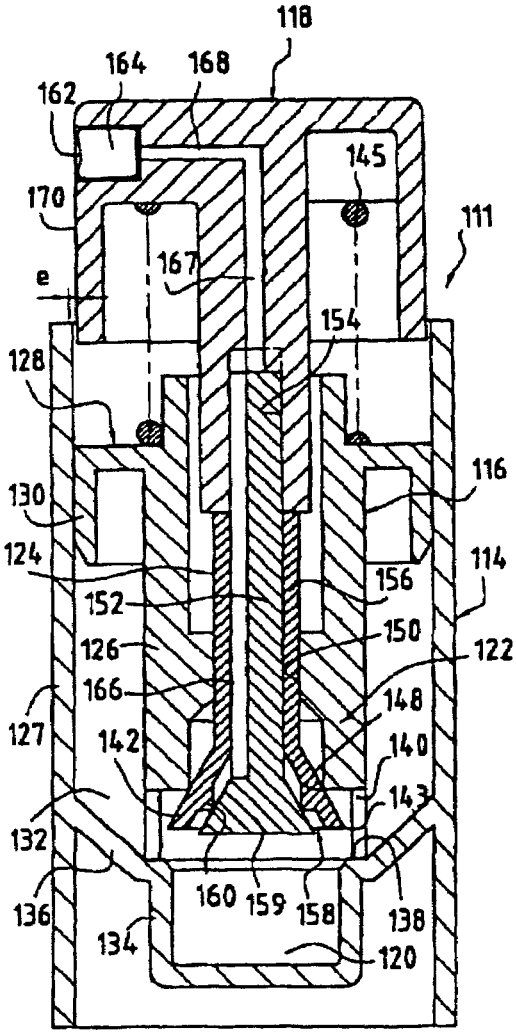
FIG. 5 is an elevation and cross-section view of a sprayer according to the invention in its idle position.
Figure 6:
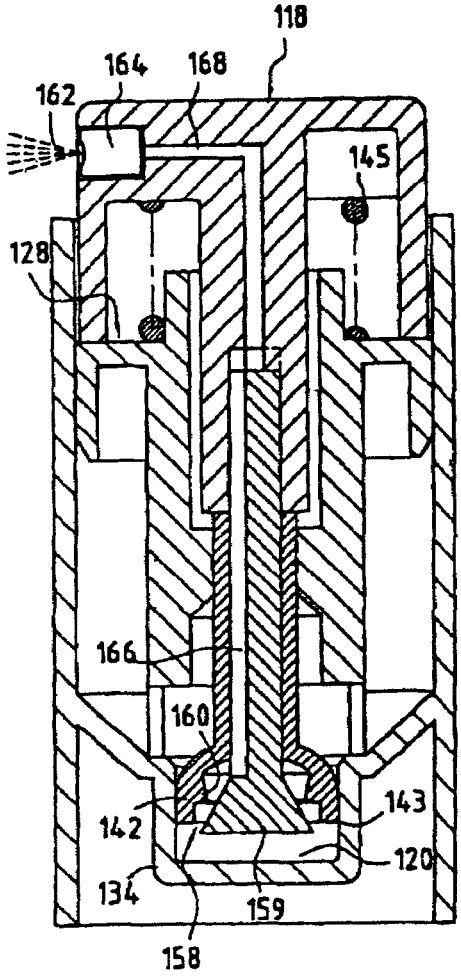
FIG. 6 is a similar view to that shown in FIG. 5, showing the sprayer in an operational stage.

The liquid product dispenser 111 shown in FIGS. 5 and 6 in this case is a sprayer, and more particularly, a miniature sprayer comprising a low-capacity reservoir 114 and a pump that is activated by a tappet 118. The pump and the reservoir are combined insofar as, as will be explained below, a dosage chamber 120 is placed directly in the bottom of the reservoir in the extension of the pump body 122 mounted in said reservoir. The tappet 118 is connected to a piston 124, which is mobile inside the pump body. The latter comprises a tubular part 126 with a smaller gauge than that of the reservoir body 127 and which covers the piston 124. In addition, the pump body 122 comprises an annular spacer 128, preferably comprising a skirt 130, as shown, mounted tight against the inner wall of the reservoir body 127. In this way, an annular chamber 132 is defined for the liquid product to be sprayed, this annular chamber being essentially defined between the outer surface of said tubular part of the pump body and the inner surface of the reservoir body. The annular spacer 128 closes the annular chamber off at the top. The bottom of the reservoir contains a part 134 with a smaller gauge, which is connected to the reservoir body, which has a larger gauge, by means of a tapered wall 136 and an annular shoulder 138 that surrounds the edge of the smaller-gauge part 134. The dosage chamber 120 is essentially defined in the smaller-gauge part 134. The annular shoulder 138 extends between the edge of the dosage chamber 120 and the adjacent end of the tapered wall 136. It forms a stop for the inner end of the pump body 122.

Near its inner end, the pump body comprises passages 140 that allow the product to flow between the annular chamber 132 and the dosage chamber 120, by the action of gravity, when the piston is in a retracted position inside the pump body (FIG. 1).

The inner end of the pump body opens into the dosage chamber 120 in order to allow the piston 124 to enter the latter when the tappet 118 is pressed. In this stroke, the piston slides in a watertight manner inside the dosage chamber. The inner end of the piston, on the side of the dosage chamber, comprises a tapered skirt 142 made from a relatively flexible material, for example, a flexible thermoplastic or an elastomer, sized so that its circular free edge 143 can slide in a watertight manner inside the dosage chamber. This tapered skirt therefore defines a suction valve with the edge of the smaller-gauge part 134 of the reservoir, near to the annular shoulder 138. This valve controls the flow of the liquid between the annular chamber 132 and the dosage chamber 120. The piston 124 and the tappet 118 are pushed outwards from the reservoir by means of a spring 145 that is supported between a top shoulder of the pump body and the tappet. Consequently, through the action of this spring, the piston 124 retracts into the pump body and the liquid is able to flow, by the action of gravity, between the annular chamber 132 and the dosage chamber 120. In this position, the free edge of the piston, in other words, the edge 143 of the tapered skirt 142 is clear from the wall of the pump body. Indeed, a slight play remains between this free edge and the wall of the pump body and, consequently, in this idle position, the tapered skirt 142 of the piston is at no risk of being distorted. In this position, the outer surface of the tapered skirt is resting against a circular edge 148 defined in the pump body. This contact, which is relatively watertight, is maintained through the action of the spring 145. Obviously, in this idle position of the piston, the passages 140 between the annular chamber 132 and the dosage chamber 120 are left open. The piston 124 is guided in a sliding movement in a bore 150 of the pump body. This sliding movement is watertight enough so as not to allow the liquid to leak through this bore.

The piston 124 comprises a rigid rod 152 mounted by force in an axial coupling 154 of the tappet. The tapered skirt, made from a flexible material, is extended by a tubular portion 156 which is a moulded piece fixed onto this rod. An outlet valve 158 is formed between one widened free end 159, which is tapered in this case, of said rod and an annular rib 160 which projects inside the tapered skirt 142. The tapered end 59 of the rod extends inside tapered skirt. When the tappet is not activated and the piston is retracted inside the pump body, the annular rib 160 rests watertight against the widened free end 159 of the rod. This arrangement defines the outlet valve, which is closed in this position. An outlet channel is made between this outlet valve 158 and an outlet port 162 defined in the tappet, more particularly in this case, the outlet port of a spraying nozzle 164 mounted by force in a lateral cavity of the tappet. In the example, the outlet channel is defined by a groove or a flat section 166 made longitudinally on the surface of the rod 152, an axial conduit 167 made in the tappet, in the projection of the rod, and a radial conduit 168 made in the tappet and extending between the conduit 167 and the cavity that contains the spraying nozzle 164. A series of fins are defined in the coupling 154 in order to prevent the end of the rod from blocking the axial conduit 167 of the tappet. The tappet 118 also comprises a lateral skirt 170 inserted in the opening of the reservoir. In order for the pump body 116 to be accurately positioned inside the reservoir and tightly maintained inside the reservoir by force at the level of the spacer 128, the radial lap e between the outer wall of the lateral skirt 170 of the tappet and the inner wall of the reservoir 114 is perfectly controlled and relatively small. The operation is as follows.

In the idle position, the dispenser is in the position shown in FIG. 5, the liquid can flow freely between the annular chamber 132 and the dosage chamber 120. The latter is therefore filled, by the action of gravity, whenever the dispenser is kept vertical. As soon as the tappet is pressed, the piston 124 moves towards the open bottom end of the pump body until it comes into watertight contact with the cylindrical lateral wall of the dosage chamber 120. As of this point, communication between the annular chamber 132 and the dosage chamber 120 is cut off and, continuing its stroke, the piston causes a slight increase of the pressure in the dosage chamber. This pressure increase causes the tapered skirt 142 to distort, which causes the outlet valve 158 to open. As of this point, the liquid trapped in the dosage chamber can rise up to the spraying nozzle 64, from which it is ejected in the form of a jet of fine drops. This is what is shown in FIG. 6.

Obviously, the sprayer described above can also, as an alternative, comprise a pump body that is entirely closed as described in reference to FIG. 1, or that is supported against the bottom of the small-gauge part 134 as described in reference to FIG. 3.

What is claimed is:

1. A dispenser for a liquid or pasty product comprising a reservoir and a pump which is activated by a tappet, said tappet being connected to a piston, which is mobile inside a pump body, characterised in that said pump body comprises a tubular part that has a smaller gauge than that of the reservoir, covering the piston, and an annular spacer by means of which it is tightly mounted against the inner wall of the reservoir such as to define an annular chamber for said product between the outer surface of said tubular part and the inner surface of said reservoir, in that a dosage chamber, with a cylindrical shape, communicating with said annular chamber, is located in the bottom of said reservoir, in that said piston enters and slides in a watertight manner inside said dosage chamber when said tappet is activated, and in that an outlet valve is defined in said piston, and further characterised in that the inner end of said piston comprises a tapered skirt, made from a flexible material, sized so that its free edge can slide in a watertight manner inside said dosage chamber.

2. A dispenser according to claim 1, characterised in that the wall of said pump body comprises passages made near its inner end in order to enable said product to flow between said annular chamber and said dosage chamber, in a position of the piston in which it is retracted inside said pump body.

3. A dispenser according to claim 1, characterised in that the outer surface of said tapered skirt is resting against a circular edge defined in the pump body, through the action of a spring, in which the passages made between said annular chamber and said dosage chamber are open in this retracted position of said piston.

4. A dispenser according to claim 1, a characterised in that said piston comprises a rigid rod mounted by force in an axial coupling of said tappet, in that said tapered skirt is protected by a tubular portion, which is a moulded part mounted on said rod, and in that an outlet valve is formed between a widened free end of said rod and an annular rib, which projects from the inner surface of said tapered skirt, and in that an outlet channel is made between said outlet valve and an outlet port defined in said tappet.

5. A dispenser according to claim 4, characterised in that said free end of said rod is tapered and in that it extends into said tapered skirt.

6. A dispenser according to claim 4, characterised in that said piston is mounted such as to slide on said rod with a predetermined stroke h.

7. A dispenser according to claim 4, characterised in that said piston is fixed on the rod and in that said tapered skirt is made from a flexible material that can be distorted.

8. A dispenser according to claim 1, characterised in that said pump body comprises a cylindrical shell which fits axially onto its inner end in order to define said dosage chamber.

9. A dispenser according to claim 1, characterised in that the inner end of said pump body is open and rests against the bottom of the reservoir.

10. A dispenser according to claim 1, characterised in that said reservoir comprises an annular shoulder defined between said annular chamber and said dosage chamber and in that the pump body is resting against this shoulder.

11. A dispenser according to claim 1, characterised in that said piston is guided such as to slide in a bore of the pump body.

12. A dispenser according to claim 1, characterised in that said tappet comprises a lateral skirt inserted in the opening of said reservoir with a controlled low radial lap between the outer wall of said lateral skirt and the inner wall of said reservoir, against which said annular spacer is tightly mounted in order to secure the position of said pump body inside said reservoir.

13. A dispenser for a liquid or pasty product comprising a reservoir and a pump which is activated by a tappet, said tappet being connected to a piston, which is mobile inside a pump body, characterised in that said pump body comprises a tubular part that has a smaller gauge than that of the reservoir, covering the piston, and an annular spacer by means of which it is tightly mounted against the inner wall of the reservoir such as to define an annular chamber for said product between the outer surface of said tubular part and the inner surface of said reservoir, in that a dosage chamber, with a cylindrical shape, communicating with said annular chamber, is located in the bottom of said reservoir, in that said piston enters and slides in a watertight manner inside said dosage chamber when said tappet is activated, and in that an outlet valve is defined in said piston, and further characterised in that the inner end of said pump body is open and rests against the bottom of the reservior.

14. A dispenser for a liquid or pasty product comprising a reservoir and a pump which is activated by a tappet, said tappet being connected to a piston, which is mobile inside a pump body, characterised in that said pump body comprises a tubular part that has a smaller gauge than that of the reservoir, covering the piston, and an annular spacer by means of which it is tightly mounted against the inner wall of the reservoir such as to define an annular chamber for said product between the outer surface of said tubular part and the inner surface of said reservoir, in that a dosage chamber, with a cylindrical shape, communicating with said annular chamber, is located in the bottom of said reservoir, in that said piston enters and slides in a watertight manner inside said dosage chamber when said tappet is activated, and in that an outlet valve is defined in said piston, and further characterised in that said reservoir comprises an annular shoulder defined between said annular chamber and said dosage chamber and in that the pump body is resting against this shoulder.

* * * * *